US005087904A

United States Patent [19]

DeVolpi

[11] Patent Number: 5,087,904

[45] Date of Patent: Feb. 11, 1992

[54] JOY STICK

[76] Inventor: Dean DeVolpi, 603 Columbine, Lisle, Ill. 60532

[21] Appl. No.: 477,478

[22] Filed: Feb. 9, 1990

[51] Int. Cl.[5] ..... H01C 10/16

[52] U.S. Cl. ..... 338/128; 74/471 XY

[58] Field of Search ..... 338/128; 200/6 A; 74/471 XY

[56] References Cited

U.S. PATENT DOCUMENTS 3,629,775 12/1971 Kindred ..... 338/128

*Primary Examiner*—Marvin M. Lateef

*Attorney, Agent, or Firm*—Hill, Van Santen, Steadman & Simpson

[57] ABSTRACT

A joy stick has a handle attached to a ball-shape member which is formed with a groove below its largest diameter into which an electrical conductive spring is mounted. The ball is mounted in a spherical cavity upon which are formed resistive paths which are engageable by the spring on the ball. The ball is moveable such that the spring can vary the resistance on the resistive paths so as to provide electrical signals which indicated any time the position of the ball relative to the socket.

13 Claims, 1 Drawing Sheet

JOY STICK

CROSS-REFERENCES TO RELATED APPLICATION

Patent application Ser. No. 07/055,179 filed May 28, 1987 entitled "Joy Stick Controller" in which the inventors are Marino Cecchi and Dean DeVolpi.

BACKGROUND OF THE INVENTION

1. Field of the Invention

This invention relates in general to joy sticks and in particular to a novel joy stick which comprises a ball which carries an electrical conductive spring engageable with conductive paths mounted in the surface of the socket.

2. Description of the Prior Art

The following U.S. Pat. Nos. illustrate various joy stick structures and variable potentiometers: 3,531,754, 3,533,043, 3,576,514, 3,900,817, 3,905,097, 3,964,011, 4,095,210, 4,121,188, 4,158,831, 4,225,845, 4,297,671, 4,352,084, BI 4,355,293, 4,361,824, 4,500,867, 4,533,899, 4,555,960, 4,590,339, 4,621,250, 4,733,214, 4,739,128, 4,748,441, 4,758,692, 4,769,517, 4,784,008, 4,795,952, 4,810,994.

SUMMARY OF THE INVENTION

The present invention provides a joy stick controller which comprises a ball and a socket wherein an expanded coil spring is attached to the ball, as for example, in a groove so that it can make electrical contact with resistors formed on the socket. As the ball is moved, the spring makes electrical contact at different points on the resistor on the socket so as to vary the resistance to produce an electrical output signal which indicates the position of the ball. By mounting the spring on the ball at a location which is smaller than the diameter of the ball, the spring provides a bias between the ball and to the socket. It is to be realized, of course, that the spring may be mounted on the inner surface of the socket and that the resistors can be mounted on the ball also to provide a joy stick.

A plurality of resistors are mounted on a non-planar surface or an extended surface of revolution such that the surface of revolution intersects its axis of rotation at at least one point. The resistors can be of any geommetry or shape and may be linear or non-linear. Electrical contact is made on at least one point on each resistor.

The material from which the resistors are made may be: carbon composite, wound wire, potentiometer thick film (PTF), carbon impregnated rubber, carbon film, carbon impregnated plastic, hot molded carbon, cermet, metal ceramic or cermet ink.

Different surfaces which can be used includes spheres, ellipses, cones and parabolas.

Electrical contact can be made with an expanded coil spring which is closed on the inside. The spring matches the contour of the resistor surface so as to provide multiple nonabrasive contact so as to reduce noise. These springs can have the shapes of an extended ellipsoid, triangular with no sharp corners, helicoil.

A joy stick is formed using a ball and socket and the resistors can be either on the ball or on the socket. The resistors are mounted so that they are opposed to one another in the three dimensional 90° fashion and a spring is inlaid around the ball so as to form an electrical contact. The ball may be coinjection molded to allow the resilient material-like KRATON to be injected to form a resilient base for the spring to rest upon. Thus, when the ball and spring are rotated in the socket with the resistors, the rotation of the ball through the spring contact and resistors is directly translated into electrical analog signals indicating the x and y coordinates. A joy stick can be self-centering or free floating. Adjustments can be made for offsetting the resistors by moving the resistor within the socket. Self-centering can be accomplished by the top part of the case having a flexible rubber membrane or by having rubber at the bottom of the ball which is attached to it or the socket. The advantages of the invention are:

1. Two axis control in the x-y axis with resistors at right angles to each other.
2. The minimum number of parts which increases the reliability of the device.
3. There is no high shear or torque on any of the components.
4. A controlled contact force results because the contact is not made with a simple canileverly supported beam like exists in most potentiometers.
5. Only four components are required to make an analog joy stick comprising a ball-stem, a spring, a top case and a bottom case whereas standard joy sticks have a minimum of thirty parts.
6. A miniature analog joy stick can be manufactured which is small enough to fit on a keyboard and can be smaller than the keyboard keys which can eliminate the need for a mouse in a computer.
7. The joy stick can be completely sealed to prevent external contamination.
8. Two or more resistors can be mounted in each axis to provide redundancy and high reliability application.
9. There are many applications to which the invention can be applied because the ball and socket is a very simple mechanical positioning system. Examples of different applications are for positioning mirrors on cars in an inexpensive manner, positioning seats in cars, positioning an arm, a hand or finger device for robatics and for positioning artificial limbs.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
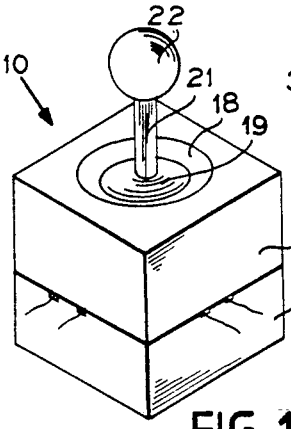
FIG. 1 is a perspective view of the novel joy stick of the invention.

FIG. 1 illustrates the novel joy stick 10 of the invention which includes a ball 19 of hard plastic material and from which a first side handle 21 extends that carries a knob 22.

Figure 2:
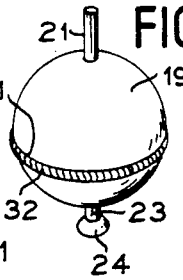
FIG. 2 is a perspective view of the ball of the invention.
Figure 4:
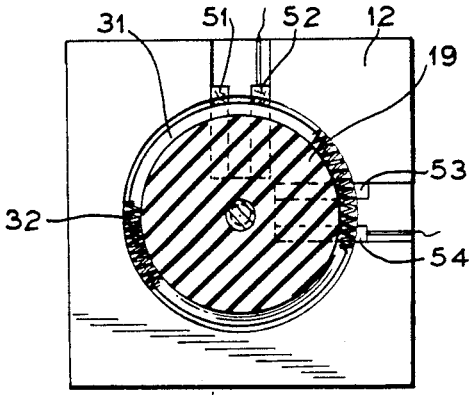
FIG. 4 is a top sectional view of the joy stick.

The ball 19 is mounted in a socket 13 formed between two members 11 and 12. The top block member 11 is formed with an opening 18 through which the shaft 21 and knob 22 extend so as to allow the ball 19 to be moved relative to the socket formed in the members 11 and 12. As is shown in FIGS. 2 and 4, the upper block member 11 is formed with a socket 17 which generally conforms to the ball 19 and the lower block 12 is formed with a socket 13 which conforms to the ball 19. An opening 14 is formed in the block member 12 through which a flexible pin 23 extends and which has its upper end connected to the ball 19. The lower end of the flexible member 23 is formed with an enlarged portion 24 which seats in tapered opening 16 which joins the opening 14. The member 23 with its head 24 provides a spring bias for returning the ball 19 to the center position when the knob 22 is released.

Figure 3:
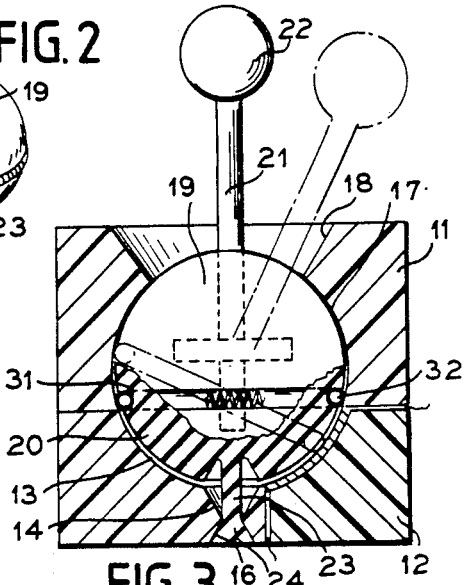
FIG. 3 is a front vertical view of the joy stick.

A groove 31 is formed generally horizontally on the ball 19 when the ball is in the centered position and slightly below the largest diameter of the ball. An electrically conductive spiral spring 32 is mounted in the groove 31 such that its outer surface engages the inner socket walls 13 and 17 of the members 11 and 12. The spring is partially compressed so as to bias the ball 19 upwardly relative to FIG. 3. The spring 32 may extend completely around the ball or may be sectionally formed.

Figure 5:
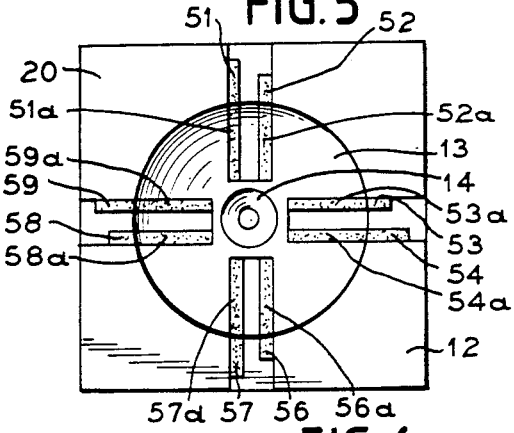
FIG. 5 is a top view illustrating the electrical; conductive paths formed in the lower portion of the socket.

A plurality of electrical contacts are formed on the lower member 12 and as shown in the top view of FIG. 5 wherein the upper block 11 has been removed, a first pair of electrical contacts 51 and 52 extend from the planar surface 20 of the member 12 into the curved portion 13. The curved portions of the electrical contacts 51 and 52 are designated 51*a* and 52*a*, respectively. Third and fourth contacts 53 and 54 extend on the planar surface 20 of the member 12 and down into the opening 13 with portions 53*a* and 54*a*. From the lower portion of FIG. 5, a pair of electrical conductors 56 and 57 extend on the flat portion 20 of the member 12 and have curved portions which 56*a* and 57*a* which extend into the socket 13. From the left side of the drawing relative to FIG. 5, electrical contacts 58 and 59 extend on the flat portion 20 and have curved portions 58*a* and 59*a* which extend down into the curved socket portion 13. In each of the pairs of the conductors 51, 52, 53, 54, 56 and 57, 58 and 59 one of the conductors may be made of silver which has a very low resistance and the other conductor may be made of carbon such that as the spring-shaped contact member 32 moves along the contact members different resistances will be indicated for different positions of the ball 19. It is to be realized, of course, that output terminals are connected to the leads 5!, 52, 53 and 54, 56, 57 and 58 and 59 as well as suitable voltages so that as a resistance changes with movement of the ball 19 such variations in resistance can be detected to indicate the position of the ball 19. Such signals can be used to control the movement of control devices to move them in two or more planes, for example.

FIG. 4 is a top sectional view through the ball 19 and illustrates the coil contact 32 in engagement with the electrical contacts 51, 52, 53 and 54.

Figure 6:
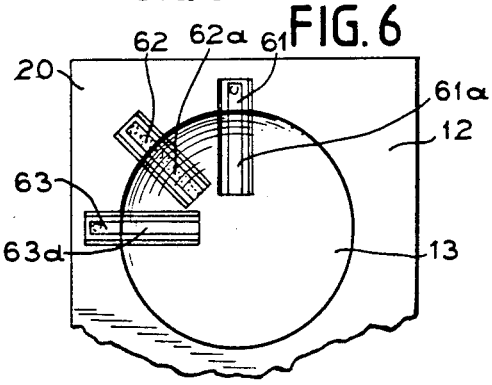
FIG. 6 is a top view illustrating a different arrangement of the resistors in the socket.

FIG. 6 illustrates a modification of the invention wherein three electrical contacts 61, 62 and 63 are formed on the planar surface of the member 12 and have curved portions 61*a*, 62*a* and 63*a* which extend down into the socket 13. The electrical contact 61 extends from the top relative to FIG. 6. The contact 63 extends from the left relative to FIG. 6 and the contact 62 extend diagonally between the contacts 61 and 63 as shown.

Figure 7:
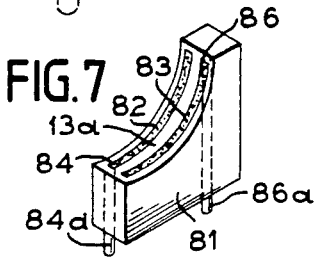
FIG. 7 illustrates a portion of the socket with resistors formed thereon.

FIG. 7 illustrates a detail sectional view of a pair of contacts 82 and 83 which are mounted on the curve surface 13*a*. The contact 82 connects to a terminal 84 which has an external lead 84*a*. The other end of member 83 connects to a contact 86 which has an external lead 86*a*.

Figure 8:
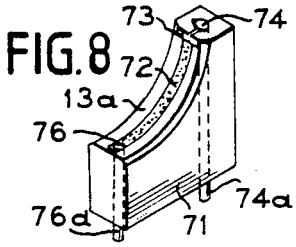
FIG. 8 illustrates a modification of the resistors on the socket.

FIG. 8 illustrates another arrangement of a resistive strip 72 on the curved surface 13*a* of the socket 13 which has a first end connected to terminal 76 which is connected to an external lead 76*a* and a second end 73 which is connected to a terminal 74 which is connected to an external contact 74*a*.

Figure 9:
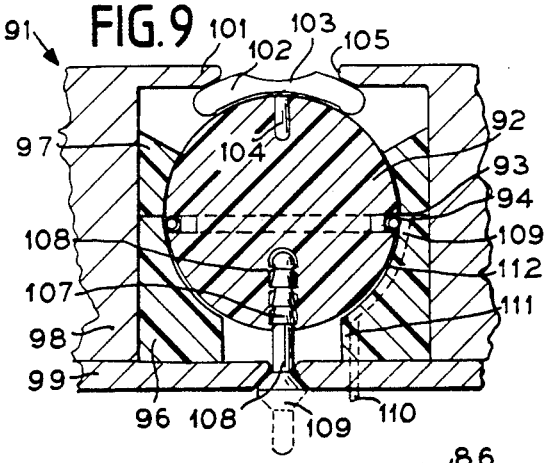
FIG. 9 illustrates a modification of the invention which can be mounted on the keyboard to a computer, for example.

FIG. 9 illustrates a modification of the invention wherein hard plastic ball 92 is provided with a groove 93 in which an endless coil spring 94 of conductive material is mounted. A finger actuator 102 is formed with a finger tip opening 103 and is formed with a pin 104 which extends into the ball 92 so as to move it. A lower portion 96 is formed with a socket 112 in which the ball 92 seats and an upper member 97 is formed with a curved socket in which the ball 92 is received. An outer housing member 98 extends substantially around the ball and has upper portions 101 which engage the finger tip control member 102 about an opening 105. The member 98 is connected to a lower member 99 which is formed with an opening 106 through which a flexible biasing member 108 extends. The flexible biasing member 108 is formed with a large portion 109 which seats in the opening 106. The upper end of flexible biasing member 109 is formed with locking shoulders 107 which are received in an opening 108 in ball 92 which is formed with mating locking shoulders. Electrical contacts such as 111, 112 and similar to contacts 51, 52 are mounted in the surface of the socket 112 and are provided with external leads such as 110 to provide electrical output from the device. The embodiment illustrated in FIG. 9 can be mounted on the keyboard of a computer, for example, and eliminates the requirement of a mouse.

The material for the resistors may be carbon composite, wire wound, potentiometers, thick film PTF, carbon impregnated rubber, carbon film, carbon impregnated plastic, hot molded carbon, cermet, metal ceramic, or cermet ink. The other pair of electrical contacts may be made of a very low resistance material such as silver or copper. The ball may be coinjection molded to allow a resilient material like KRATON to be an injected to form a resilient base for the spring to rest upon.

A flexible rubber membrane may be attached to shaft 21 of the ball and connected to the upper member 11 so as to provide self-centering rather than the use of the flexible means such as 23 and 109 illustrated in the drawing.

Although the invention has been described with respect to preferred embodiments, it is not to be so limited as changes and modifications can be made which are within the full intended scope of the invention as defined by the appended claims.

I claim as my invention:

1. A joy stick comprising a ball of insulating material formed with a groove, a contact assembly mounted in said groove, a body member formed with a spherically-shaped socket in which said ball is moveably mounted, an electrical resistive path formed on said body member within said socket and engageable with said contact assembly and means for moving said ball.

2. A joy stick according to claim 1 wherein said groove extends around the ball at a location which has a length smaller than the circumference of said ball so as to bias said ball relative to said socket.

3. A joy stick according to claim 2 wherein said means for moving said ball comprises a pin which extends from said ball through an opening formed in said body member.

4. A joy stick according to claim 2 wherein said means for moving said ball comprises a finger engaging member which is attached to said ball and which can be contacted by user through an opening in said body member.

5. A joy stick according to claim 1 comprising means for spring biasing said ball to a centered position in said socket.

6. A joy stick according to claim 1 wherein said contact assembly is a coiled spring which extends around said ball.

7. A joy stick according to claim 1 wherein said contact assembly on said ball engages said resistive path so as to produce resistance valves indicative of the position of said ball.

8. A joy stick according to claim 7 including at least one additional resistive path formed on said body member with said socket and engageable with said contact assembly.

9. A joy stick according to claim 6 wherein said coiled spring is endless.

10. A joy stick according to claim 6 wherein said coiled spring is formed of sections.

11. A joy stick according to claim 6, wherein said contact assembly is a curved electrical contact.

12. A joy stick according to claim 11 wherein said curved electrical contact is formed of metal.

13. A joy stick according to claim 11 wherein said curved electrical contact is formed of carbon.

* * * * *

UNITED STATES PATENT AND TRADEMARK OFFICE

CERTIFICATE OF CORRECTION

PATENT NO. : 5,087,904

DATED : February 11, 1992

INVENTOR(S) : Dean DeVolpi

It is certified that error appears in the above—identified patent and that said Letters Patent is hereby corrected as shown below:

Column 3 line 61, "5!" should read --51--.

Signed and Sealed this

Twenty-sixth Day of October, 1993

Bruce Lehman

*Attest:*

BRUCE LEHMAN

*Attesting Officer*

*Commissioner of Patents and Trademarks*